US007080639B1

(12) United States Patent
Pattantyus

(10) Patent No.: US 7,080,639 B1
(45) Date of Patent: Jul. 25, 2006

(54) SOFT IGBT TURN-ON IGNITION APPLICATIONS

(75) Inventor: Tom I. Pattantyus, Ann Arbor, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 11/171,666

(22) Filed: Jun. 30, 2005

(51) Int. Cl.
*F02P 3/04* (2006.01)

(52) U.S. Cl. ..... 123/651; 123/652; 123/653; 123/655

(58) Field of Classification Search ..... 123/650, 123/651, 652, 653, 655
See application file for complete search history.

(56) References Cited

U.S. PATENT DOCUMENTS

| | | | | |
|---|---|---|---|---|
| 3,949,722 | A * | 4/1976 | Linstedt et al. | 123/651 |
| 4,285,322 | A * | 8/1981 | Ina et al. | 123/651 |
| 5,274,541 | A | 12/1993 | Kimura et al. | |
| 5,505,175 | A | 4/1996 | Mai et al. | |
| 5,534,814 | A | 7/1996 | Archer | |
| 5,569,982 | A | 10/1996 | Nadd | |
| 5,603,308 | A | 2/1997 | Ooyabu et al. | |
| 5,703,743 | A | 12/1997 | Lee | |
| 5,775,310 | A | 7/1998 | Ito et al. | |
| 5,819,713 | A | 10/1998 | Kesler | |
| 5,949,273 | A | 9/1999 | Mourick et al. | |
| 6,142,130 | A | 11/2000 | Ward | |
| 6,208,185 | B1 | 3/2001 | John et al. | |
| 6,213,108 | B1 | 4/2001 | Boyer et al. | |
| 6,271,709 | B1 | 8/2001 | Kimura et al. | |
| 6,275,093 | B1 | 8/2001 | Shekhawat et al. | |
| 6,450,157 | B1 | 9/2002 | Kesler et al. | |
| 6,459,324 | B1 | 10/2002 | Neacsu et al. | |
| 6,570,413 | B1 | 5/2003 | Kumagai et al. | |
| 6,584,965 | B1 | 7/2003 | Ward | |
| 6,651,637 | B1 | 11/2003 | Morrissette et al. | |
| 6,668,811 | B1 | 12/2003 | Kesler | |
| 6,784,721 | B1 | 8/2004 | Torrisi et al. | |
| 2002/0070772 | A1 | 6/2002 | Neacsu et al. | |
| 2002/0109417 | A1 | 8/2002 | Torrisi et al. | |
| 2003/0075748 | A1 | 4/2003 | Furuie et al. | |
| 2004/0027762 | A1 | 2/2004 | Ohi et al. | |

* cited by examiner

*Primary Examiner*—Erick R Solis
(74) *Attorney, Agent, or Firm*—Brinks Hofer Gilson & Lione

(57) ABSTRACT

A circuit for controlling an ignition coil is provided. The circuit includes a first transistor, second transistor, and a capacitor. The first transistor is connected in electrical series between the ignition coil and a voltage reference. The capacitor is connected between the ignition coil and a control input of the first transistor. The second transistor is configured to selectively connect the capacitor to the voltage reference.

11 Claims, 4 Drawing Sheets

SOFT IGBT TURN-ON IGNITION APPLICATIONS

BACKGROUND

1. Field of the Invention

The present invention generally relates to a circuit for driving an ignition coil.

2. Description of Related Art

In a spark ignited internal combustion engine, ignition coils provide the voltage required for electrical current to jump across a spark plug gap. The spark ignites an air-fuel mixture in the engine cylinder causing combustion. A switch, also referred to as a coil driver, is used on the primary side of the ignition coil to control the charge and discharge cycles of the ignition coil.

A typical ignition system is illustrated in FIG. 1. The system includes an ignition coil 210 having a primary side 216 and a secondary side 218. The positive terminals of the primary side 216 and secondary side 218 of the ignition coil 210 are connected to a power source 212. The negative terminal of the primary side is connected to a switching transistor 214. The switching transistor 214 is connected between the ignition coil 210 and an electrical ground 220. The negative terminal of the secondary side 218 is connected to a spark plug 222. The spark plug 222 is connected between the ignition coil 210 and an electrical ground 220.

FIG. 2 illustrates the voltage and current profiles at various points within the prior art system. The profile of the control signal provided to the switching transistor 214 is identified by reference numeral 224, while the current flowing through the primary side 216 of the ignition coil 210 is denoted by reference numeral 226. In addition, a profile of the primary coil voltage signal, as seen on the collector of transistor 214, is denoted by reference numeral 228. In a typical charge and discharge cycle the switching transistor 214 is turned on, charging the ignition coil 210 for a specified dwell period or to a specified charge current; and then the switching transistor 214 is turned off, allowing the secondary side 218 of the ignition coil 210 to discharge stored energy across the spark plug gap.

One problem is that the sharp turn-on during the charging cycle causes an oscillation on the secondary side 218 of the ignition coil 210. FIG. 3 illustrates the dwell command signal 224, the dwell current 226, low-side voltage 228, and the undesirable secondary voltage oscillation 230. The switching transistor 214 starts out in the off-state with the negative terminal of the primary side 216 equal to the battery voltage. After the switching transistor 214 is turned on, the transistor quickly transits through its linear range into the saturated on-state with very large voltage change across the primary side 216 of the ignition coil 210. The resulting secondary voltage 230 during turn-on is a large oscillation magnitude that decays in time. If the oscillation magnitude exceeds a tolerable level, an unintended spark event can occur across the spark plug gap, resulting in premature combustion. One way to control the magnitude of the secondary oscillations is adding constraints in design of the ignition coil 210. These constraints, however, result in poor coil performance.

In view of the above, it is apparent that there exists a need for an improved circuit for driving an ignition coil.

SUMMARY

In satisfying the above need, as well as overcoming the enumerated drawbacks and other limitations of the related art, the present invention provides an improved circuit for driving an ignition coil.

Generally, the circuit includes a pair of transistors, and a capacitor. The first transistor is connected in electrical series between the ignition coil and a voltage reference. The capacitor is connected between the ignition coil and a control input of the first transistor. The second transistor is configured to selectively connect the capacitor to the voltage reference.

A third transistor and a resistor are connected in electrical series between the control input of the first transistor and the voltage reference. The third transistor is configured to selectively connect the control input of the first transistor to the voltage reference. In addition, a current source is in electrical communication with the control input of the first transistor through a diode.

In another aspect of the present invention, a diode is connected between the capacitor and the voltage reference.

In yet another aspect of the present invention, the circuit includes a fourth transistor connected between the capacitor and the control input of the first transistor. This fourth transistor is configured to selectively connect the capacitor to the control input of the first transistor.

Further objects, features and advantages of this invention will become readily apparent to persons skilled in the art after a review of the following description, with reference to the drawings and claims that are appended to and form a part of this specification.

DETAILED DESCRIPTION

Figure 1:
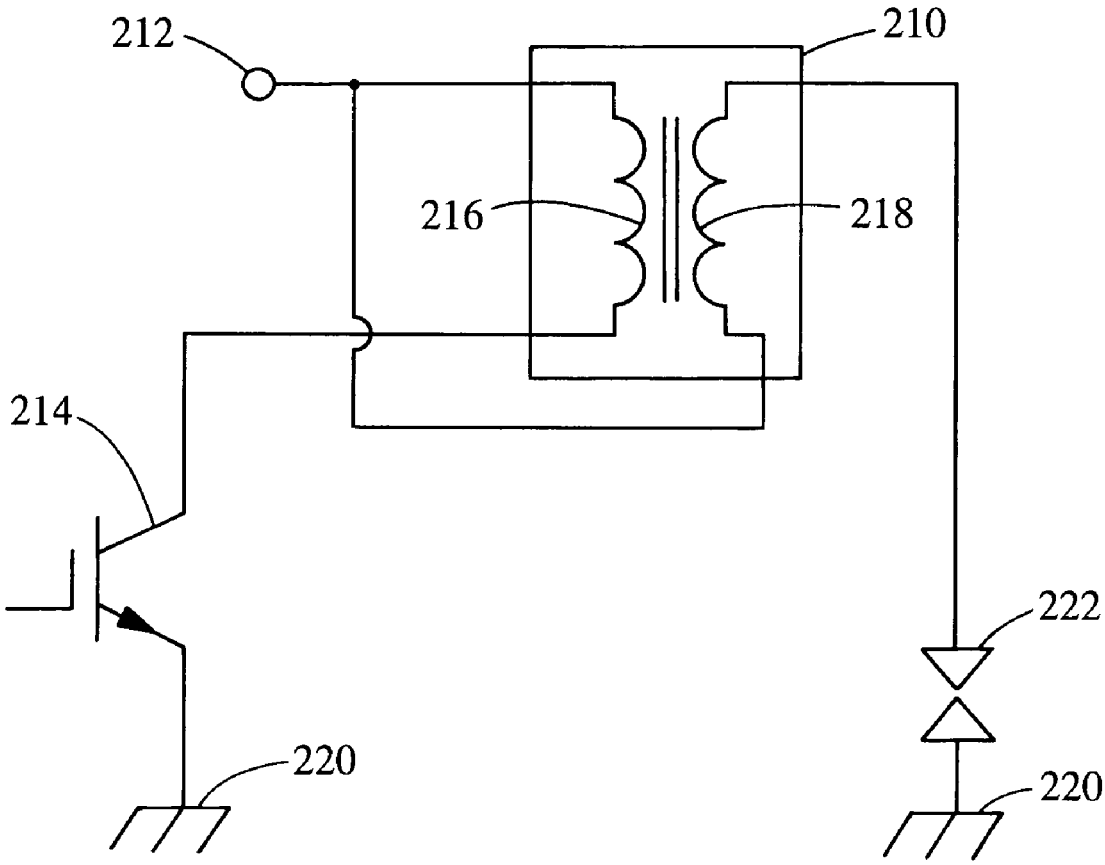
Fig. 1 Prior Art
FIG. 1 is a schematic view of a conventional spark ignition system.
Figure 2:
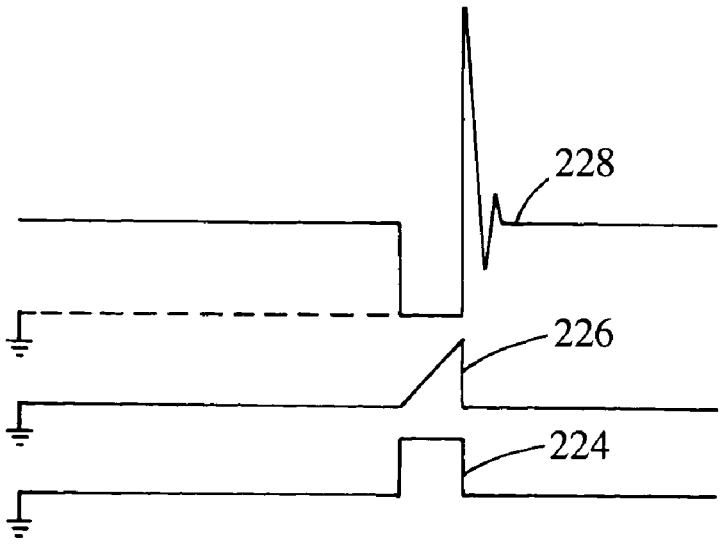
Fig. 2 Prior Art
FIG. 2 is a graph illustrating the timing of various voltage profiles for the spark ignition system of FIG. 1.
Figure 3:
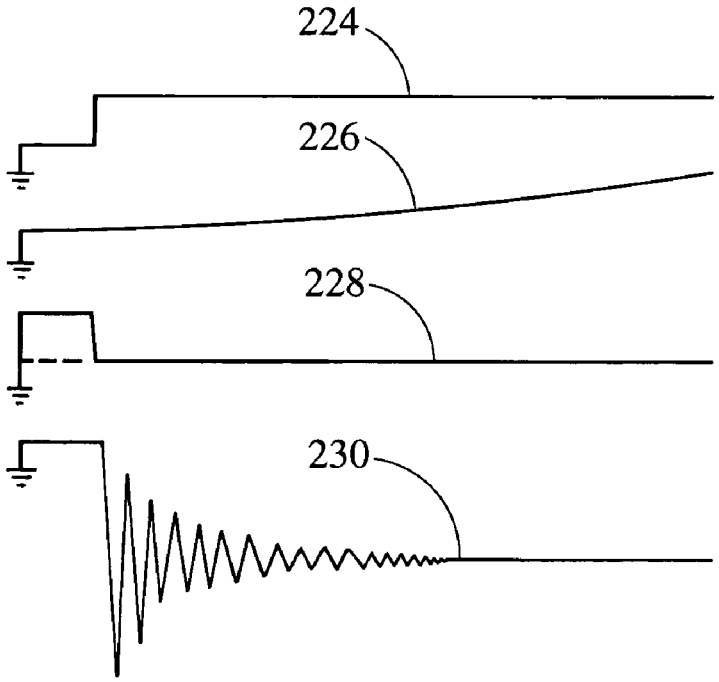
Fig. 3 Prior Art
FIG. 3 is a graph illustrating oscillation in the secondary voltage resulting from the conventional spark plug system.
Figure 4:
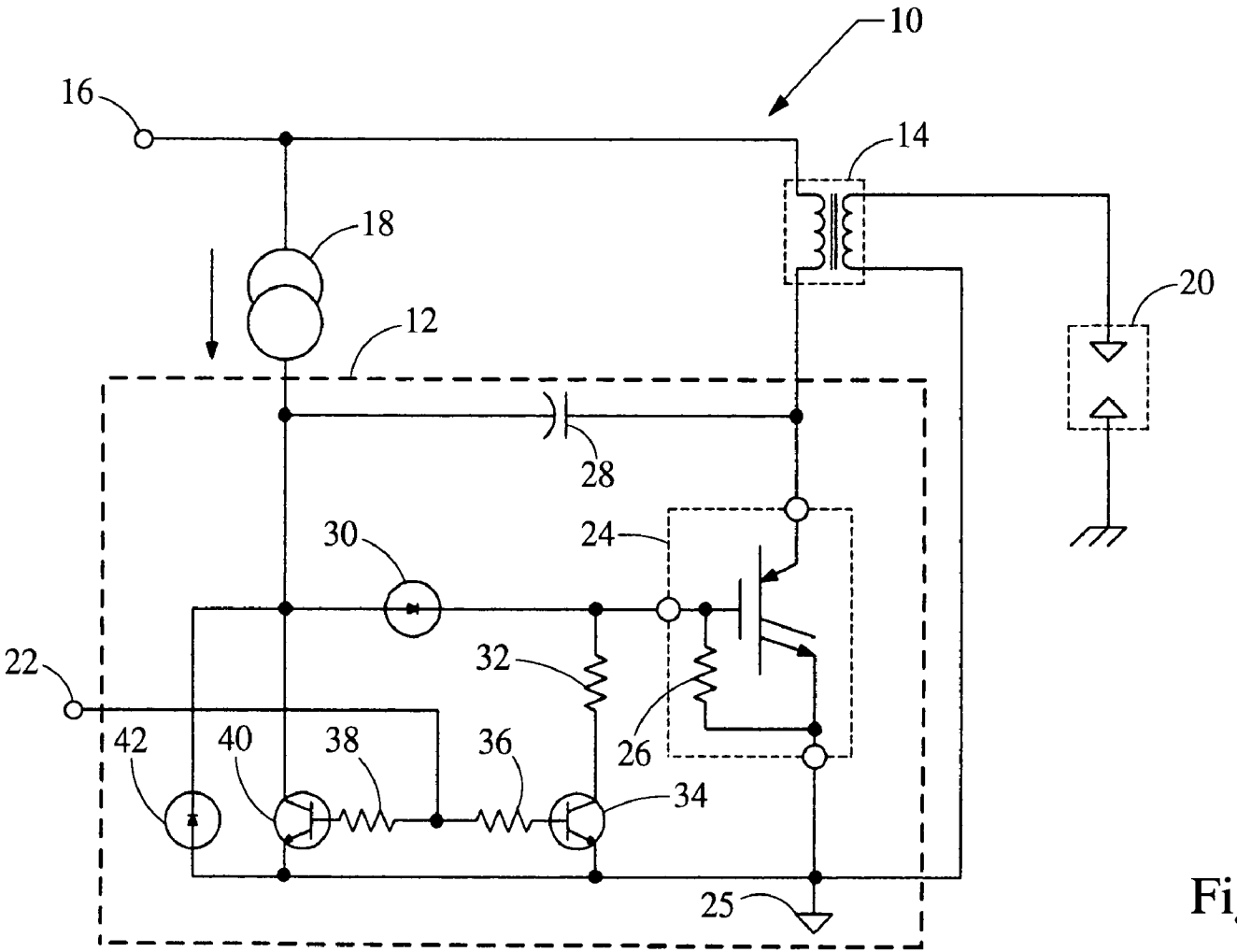
FIG. 4 is a schematic view of a circuit for driving an ignition system in accordance with the present invention.

Referring now to FIG. 4, a system embodying the principles of the present invention is illustrated therein and designated at 10. As its primary components, the system 10 includes a switching circuit 12 and an ignition coil 14.

The switching circuit 12 receives power from a power source 16 through a current source 18. The power source 16 is also connected to one of the primary terminals of the ignition coil 14. The switching circuit 12 also receives a control signal at input node 22. The switching circuit 12 is connected to the other terminal of the primary side of the ignition coil 14 and controls the ignition coil 14 based on the control signal provided to input node 22. The secondary side of the ignition coil 14 has one terminal connected to electrical ground and the other terminal connected to a spark plug 20. Based on the control of the switching circuit 12, the ignition coil 14 generates a voltage to fire the spark plug 20.

The switching circuit 12 itself includes a transistor 24 and a capacitor 28. The transistor 24 is shown as an IGBT transistor, however, other transistors are also contemplated. Resistor 26 is indicative of the internal gate-emitter resistance of an IGBT transistor. The collector of transistor 24 is connected to the primary side of the ignition coil 14. The emitter of transistor 24 is connected to an electrical ground 25. The capacitor 28 is connected to the collector of transistor 24 and is in electrical communication with the gate of transistor 24 through diode 30. As such, capacitor 28 acts as a Miller effect capacitor. The anode of diode 30 is connected to both the current source 18 and capacitor 28. The cathode of diode 30 is connected to the gate of transistor 24. Also connected to the gate of transistor 24 is resistor 32. Resistor 32 is selectively in communication with electrical ground 25 through transistor 34. Transistor 34 shown as an NPN bipolar transistor, however, other commonly known transistors are contemplated herein. As such, the collector of transistor 34 is connected to resistor 32 and the emitter of transistor 34 is connected to electrical ground 25. Transistor 34 receives the control signal from node 22 through resistor 36, thereby selectively providing a path from resistor 32 to electrical ground 25.

In addition, the control signal provided to input node 22 is provided to transistor 40 through resistor 38. Resistor 38 is connected to the control input of transistor 40. Transistor 40 is shown as an NPN bipolar transistor, however, other common transistors may be readily substituted. The base of transistor 40 is connected to resistor 38 to selectively connect capacitor 28 to electrical ground 25. As such, the collector of transistor 40 is connected to capacitor 28 and the emitter of transistor 40 is connected to an electrical ground 25. Further, diode 42 is connected between capacitor 28 and electrical ground with the anode of diode 42 connected to electrical ground and the cathode of diode 42 connected to capacitor 28.

Figure 5:
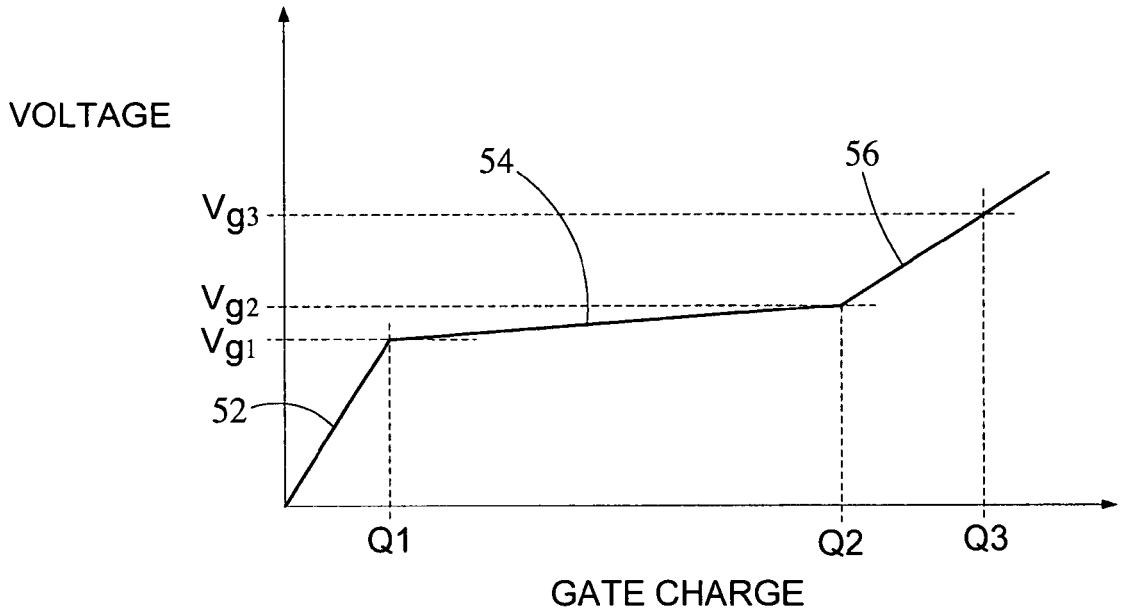
FIG. 5 is a graph illustrating the timing of the switching voltage profile for the circuit illustrated in FIG. 4.

For the circuit described, the gate voltage vs. gate charge characteristics of the transistor 24 are illustrated in FIG. 5. Over region 52, the collector current is zero, and the gate impedance of transistor 24 is defined by the relationship $C_{g1}=Q1/N_{g1}g$. In region 54, the enhancement gate region, collector current is turned on at $V_{g1}$, Q1 and the collector current of transistor 24 sharply increases with increasing collector to emitter voltage. The gate capacitance, in region 54, is defined by the relationship $C_{g2}=(Q2-Q1)/(V_{g2}-V_{g1})$. In region 56, the gate is fully enhanced. The collector current of transistor 24 slightly increases with increasing collector to emitter voltage increase. The gate capacitance of transistor 24 is defined by the relationship $C_{g3}=(Q3-Q2)/V_{g3}-V_{g2})$.

At the point between region 52 and region 54, the collector current is turned on. Due to the inductive load represented by the primary winding of the ignition coil 14, the current begins to increase at a rate given by $$\Delta i/\Delta t = V\text{coil}/L\text{coil},$$

where $\Delta i/\Delta t$ is the rate of change of current, Vcoil is the voltage across the coil (approx. equal to VIGN, the voltage provided by power source 16) and Lcoil is the primary inductance. When the collector voltage of transistor 24 quickly drops to near zero, the rate of change of voltage across the primary winding changes very fast. The fast transient primary voltage change may trigger a large enough secondary voltage to cause forward ignition at the beginning of the dwell period. The configuration in FIG. 4 slows the initial voltage transient across the coil primary preventing ignition.

When transistor 24 is off transistors 40 and 38 are fully on, their collector voltages are almost at ground potential. Current from the current source 18 is shunted away from the gate of transistor 24 by transistor 40, while transistor 34 clamps the gate to ground through resistor 32. The collector of transistor 24 is at VIGN and capacitor 28 is charged to VIGN.

When transistor 24 is on, transistors 40 and 34 are turned off and the current from current source 18 is channeled into the gate of transistor 24 which will charge to voltage $V_{g1}$. When the gate voltage is greater than $V_{g1}$, transistor 24 begins to conduct and the collector voltage starts to change negatively. The negative voltage drop begins to discharge capacitor 28 and the discharge current flows from the current source 18 through the collector of transistor 24 and to ground. The current from the current source 18 will be reduced by the Miller feedback current which will limit the rate of change of collector voltage. The Miller feedback current is equal to $C_m(\Delta V_{ce}/\Delta t)$, where $C_m$ is the capacitance of capacitor 28, $V_{ce}$ is the collector-emitter voltage of transistor 24, and t is time. A dynamic equilibrium is established whereby the portion of the current charging the gate of transistor 24 and causing the collector voltage to drop balances the Miller feedback current. By this process, the current turn-on rate is precisely regulated and the voltage drop across the primary winding of the ignition coil 14 is slowed. Accordingly, the secondary voltage, induced by the changing primary voltage, is reduced so that forward firing is prevented.

When transistor 24 changes from fully-on to off, transistors 40 and 34 are turned on again. Transistor 40 will clamp the current from current source 18 to ground and transistor 34 will discharge the gate of transistor 24 through the resistor 32. Therefore, the collector current is quickly turned off. Since the spark plug does not yet represent any reflected load on the primary, the collector voltage of transistor 24 will change positively at a high rate and large amplitude (fly-back). Transistor 40 not only clamps the current from current source 18 to ground but also the larger capacitive current caused by the fly-back voltage ($\Delta V_{ce}/\Delta t$). Without the clamping, the Miller feedback would slow the fly-back rate of change and the fly-back amplitude preventing the evolution of the high secondary voltage (up to 35 kV).

The primary fly-back voltage peaks at several hundreds volts and the peak marks the beginning of sparking. The spark current puts a heavy load across the secondary of the ignition coil 14 and the secondary voltage quickly drops down to about 800V which is the corona voltage during the combustion. Due to the discharge path provided by diode 42, capacitor 28 then discharges from a high positive voltage converging to VIGN.

Diode 30 ensures that transistor 34 clamps the gate of transistor 24 to ground. Clamping of the gate is needed if the fly-back voltage exceeds the threshold voltage of the Zener diodes integrated within transistor 24. In that case, transistor 24 is turned on again limiting the collector voltage to approximately the Zener voltage and the bias current of the Zener diode will have a path to ground through the resistor 32.

As a person skilled in the art will readily appreciate, the above description is meant as an illustration of implementation of the principles this invention. This description is not intended to limit the scope or application of this invention in that the invention is susceptible to modification, variation and change, without departing from spirit of this invention, as defined in the following claims.

We claim:

1. A circuit for driving an ignition coil, the circuit comprising:

a first transistor connected in electrical series between the ignition coil and a voltage reference;

a capacitor connected between the ignition coil and a control input of the first transistor; and a second transistor configured to selectively connect the capacitor to the voltage reference.

2. The circuit according to claim 1, further comprising a third transistor configured to selectively connect the control input of the first transistor to the voltage reference.

3. The circuit according to claim 2, wherein a resistor is connected in electrical series with the third transistor between the control input of the first transistor and the voltage reference.

4. The circuit according to claim 1, further comprising a current source in electrical communication with the control input of the first transistor.

5. The circuit according to claim 4, further comprising a diode connected between the current source and the control input of the first transistor.

6. The circuit according to claim 5, wherein an anode of the diode is connected to the current source and a cathode of the diode is connected to the control input of the first transistor.

7. The circuit according to claim 1, wherein the first transistor is an IGBT.

8. The circuit according to claim 7, the collector of the first transistor is connected to the capacitor and the emitter of the first transistor is connected to the voltage reference.

9. The circuit according to claim 1, wherein a diode is connected between the capacitor and the voltage reference.

10. The circuit according to claim 9, wherein an anode of the diode is connected to the voltage reference and a cathode of the diode is connected to the capacitor.

11. The circuit according to claim 1, wherein the first transistor is configured in an on state such that the coil current through the ignition coil increases linearly.

* * * * *